United States Patent [19]

Koboshi et al.

[11] Patent Number: 4,601,975

[45] Date of Patent: Jul. 22, 1986

[54] METHOD FOR PROCESSING LIGHT-SENSITIVE SILVER HALIDE COLOR PHOTOGRAPHIC MATERIAL

[75] Inventors: Shigeharu Koboshi; Kazuhiro Kobayashi; Masao Ishikawa; Masahiko Kon; Satoru Kuse, all of Hino, Japan

[73] Assignee: Konishiroku Photo Industry Co., Ltd., Tokyo, Japan

[21] Appl. No.: 683,931

[22] Filed: Dec. 20, 1984

[30] Foreign Application Priority Data

Dec. 23, 1983 [JP] Japan ..... 58-242140
Jan. 26, 1984 [JP] Japan ..... 59-13168

[51] Int. Cl.[4] ..... G03C 7/00; G03C 5/38

[52] U.S. Cl. ..... 430/393; 430/400; 430/430

[58] Field of Search ..... 430/393, 400, 430

[56] References Cited

U.S. PATENT DOCUMENTS 3,907,568 9/1975 Shirasu et al. ..... 430/393
4,040,838 8/1977 Yamaguchi ..... 430/393

*Primary Examiner*—Mary F. Downey
*Attorney, Agent, or Firm*—Frishauf, Holtz, Goodman & Woodward

[57] ABSTRACT

A method for processing a light-sensitive silver halide color photographic material by developing a light-sensitive silver halide color photographic material after imagewise exposure with a color developing solution containing a p-phenylenediamine type color developing agent containing at least one water-soluble group on its amino group and then subjecting the developed material to direct processing with a bleach-fixing solution kept in a state of being oxidized, which comprises using a diethylenetriaminepentaacetic acid iron (III) complex as the bleaching agent for said bleach-fixing processing.

14 Claims, No Drawings

METHOD FOR PROCESSING LIGHT-SENSITIVE SILVER HALIDE COLOR PHOTOGRAPHIC MATERIAL

BACKGROUND OF THE INVENTION

This invention relates to a method for processing a light-sensitive silver halide color photographic material, particularly to a processing method in which stain generation occurring in the bleaching step is suppressed.

Diequivalent couplers which can generally improve much of the image quality of a light-sensitive silver halide color photographic material has been employed in many light-sensitive color photographic materials in recent years. However, as well known in the art, when said diequivalent coupler is processed in a processing bath having a bleaching ability in which a color developing solution is mixed therein, color fog called as stain is liable to be formed, whereby a serious problem which is undesirable in color reproduction of photographic image may be caused.

Also, in the bleaching step, an aminopolycarboxylic acid iron complex is primarily employed as the bleaching agent, and when processing is conducted with a bleaching solution or a bleach-fixing solution employing an ethylenediaminetetraacetic acid iron (III) complex, which is the most common of said aminopolycarboxylic acid iron complexes in this field of the art, the above stain is known to be readily generated. It is also known that such a phenomenon occurs frequently particularly when direct bleaching processing or bleach-fixing processing is conducted after color developing and processing is conducted during the season when the amount of the light-sensitive silver halide color photographic materials to be processed is small.

As a means for prevention of such a phenomenon, it has been proposed to modify the solution by addition of a sulfite when the amount of the light-sensitive silver halide color photographic materials to be processed is reduced.

Reduction in amount of the light-sensitive silver halide color photographic materials to be processed often occurs at the weekend during one week, and during the year, in the periods of from the end of January to March and from July to September. During these periods, depression may occur even to ¼ to 1/5 of the amount at the period of maximum processing. Such an extreme reduction in processing amount is characterized by lowering in frequency of renewal of a tank solution very susceptible to air oxidation such as a bleach-fixing solution with fresh supplementing solution to result in deterioration of the processing solution, whereby stain is liable to be generated. In such a case, there also ensues the economical problem that the tank solution must but be renewed with a fresh one.

On the other hand, when carrying out direct bleach-fixing processing after color developing, the color developer is brought into the direct bleach-fixing solution by conveying of the photographic light-sensitive material, and therefore the developing agent is oxidized in the bleach-fixing solution, thereby causing readily color formed stain. Particularly, this tendency becomes intensified when the renewal frequency is lowered with reduction in amount of processing.

Further, in these days, for the purpose of prevention of environmental pollution or conservation of resources, the low supplementing processing is under progress, in which processing is conducted with an amount as small as possible of a processing solution supplemented per unit area of the light-sensitive silver halide color photographic material to be processed. According to such a processing, particularly the proportion of the color developer entrained into the bleach-fixing solution as mentioned above will be increased to give rise readily to generation of stain and also lower the bleach-fixing speed.

To cope with these problems, for the purpose of preventing so far as possible generation of stain and enhancing storability of the solution on reduction of processing amount, it has been recommended and practiced in part to add a certain quantity of a sulfite or a sulfite releasing compound such as sulfurous acid formaldehyde adduct.

Also, for prevention only of stain, it is also well known in the art and practiced to carry out processing on the acidic side by lowering the pH value of the bleach-fixing solution, whereby stain can be suppressed to a great extent. However, according to such a method, even if generation of stain itself may be prevented, the amount of the reducing agent becomes too much at the initial period of the week when the processing amount is great, to result in reduction of the bleaching agent of an ethylenediaminetetraacetic acid iron (III) complex (EDTA Fe(III) salt) to form an ethylenediaminetetraacetic acid iron (II) complex (EDTA Fe(II) salt), whereby there is involved the problem of causing a serious drawback of poor color restoration due to leuco formation of the cyan dye. On the other hand, lowering the pH accelerates hydrogen addition (protonation) to the above cyan dye with the EDTA Fe(II) salt which is the reduced product formed by the bleaching reaction of silver, thereby also increasing disadvantageously poor color restoration. Thus, generally speaking, with a bleaching solution of the prior art employing EDTA Fe(III), salt, it has been practically impossible to make the pH of the bleach-fixing solution 6.5 or less, even the pH of the bleaching solution 5.9 or less.

On the other hand, as to the upper limit of the pH of a bleaching solution or a bleach-fixing solution, it cannot generally be made 7.5 or higher, because higher pH will cause markedly generation of the above stain. Accordingly, although these processing solutions are prescribed generally as useful at pH 2.0 to 8.0, they are actually managed at a very narrow range of pH 6.0 to 7.5, and it is further required to manage more precisely the processing solution such as for correction of the solution by addition of a sulfite corresponding to the supplementing amount, measurement of oxidation-reduction potential or the processing amount.

Further, in these processing solutions, management by air oxidation (aeration) requires more precise system control.

Generally speaking, in bleaching solutions or bleach-fixing solutions, oxidizing agents such as EDTA Fe(III) salts are known to cause undesirable problems of being reduced through (1) the bleaching reaction with silver, (2) the redox reduction with a sulfite, (3) the redox reduction by entrainment of a reducing agent (developing agent, etc.) in the developer, to form an EDTA Fe(II) salt which reduces the dye. Accordingly, it is necessary to oxidize such an EDTA Fe(II) salt to be returned to an EDTA Fe(III) salt, and it is generally required to practice air oxidation constantly or intermittently by the method of passing bubbles of air through the solution which is called as the abovementioned aeration. However, while this method is a very simple and effective method for improvement of bad color restoration, the so called overaeration, in which aeration is excessively effected, tends to occur, under which state generation of stain will occur markedly mentioned above. For this reason, until now, there is employed the management system where processing is conducted by controlling the air quantity while measuring constantly the redox potential at a level where the reduced product EDTA Fe(II) remains slightly. Thus, management has been very complicated.

SUMMARY OF THE INVENTION

An object of the present invention is to provide a method for processing a light-sensitive silver halide color photographic material, when subjecting a light-sensitive silver halide color photographic material to direct bleach-fixing processing after developing, in which there is caused no trouble such as generation of stain or poor color restoration of cyan dye regardless of the amount of processing or the duration of storage, and which is also excellent in desilverization speed and easy in processing management.

Another object of the present invention is to provide a method for processing a light-sensitive silver halide color photographic material, which is easy in liquid management of the bleach-fixing solution and also high in the effects of conservation of resources and prevention of environmental pollution.

The present inventors have made extensive studies and consequently found that the above objects of the present invention can be accomplished by a method for processing a light-sensitive silver halide color photographic material by developing a light-sensitive silver halide color photographic material after imagewise exposure with a color developing solution containing a p-phenylenediamine type color developing agent containing at least one water-soluble group on its amino group and then subjecting the developed material to direct processing with a bleach-fixing solution kept in a state of being oxidized, which comprises using a diethylenetriaminepentaacetic acid iron (III) complex as the bleaching agent for said bleach-fixing processing.

That is, the present inventors have found a surprising fact that, when the color developer containing the color developing agent of the present invention is mixed into a bleaching solution or a bleach-fixing solution containing a diethylenetriaminepentaacetic acid iron (III) complex, generation of stain which has been the problem in the prior art as observed when a color photographic light-sensitive material is processed with a color developer mixed into a bleaching solution or a bleach-fixing solution containing an ethylenediamine tetraacetic acid iron (III) complex becomes markedly small, and also when processing is conducted with a bleach-fixing solution kept in a state of being oxidized, particularly even if an overaeration state may intentionally be created, no stain is generated at all. Further poor color restoration is not caused but rather desilverization is improved. At the same time, it has been also found that there is no improvement of desilverization when the amount of the color developer mixed into the bleach-fixing solution is small, and that no prevention of stain generation is possible even with the bleach-fixing solution of the present invention, if the above processing is conducted with accompaniment of air oxidation with the use of a color developing agent which is outside the scope of the present invention. Thus, the present inventors have found that the above objects of the present invention can be accomplished according to the effective combination of the treatment steps of the present invention.

DETAILED DESCRIPTION OF THE PREFERRED EMBODIMENT

The light-sensitive silver halide color photographic material according to the present invention contains respective couplers of yellow, magenta or cyan, and said couplers may include the divalent couplers represented by the formula [I] shown below:

Formula [I]

A—Z wherein A represents a group at the coupling active site of a yellow coupler, a magenta coupler or a cyan coupler from which a hydrogen atom is removed, and Z represents a group which is eliminated through the reaction between the coupler and the oxidized product of a developing agent.

The yellow image forming coupler residue represented by A may include preferably coupler residues of pivaloylacetanilide type, benzoylacetanilide type, malondiamide type, benzothiazerylacetamide type, benzothiazolylacetate type, benzoxazolylacetamide type, benzoxazolylacetate type, benzimidazolylacetamide type, benzimidazolylacetate type; residues derived from hetero-ring substituted acetamide and hetero-ring substituted acetate as included in U.S. Pat. No. 3,841,880.

The magenta image forming coupler residue is peferably a coupler residue having a 5-oxo-2-pyrazoline nucleus or pyrazolo-[1,5-a]benzimidazole nucleus or 1-H-pyrazole-[3,2-c]-S-triazole nucleus.

The cyan image forming coupler residue is preferably a coupler residue having a phenol nucleus or ζ-naphthol nucleus.

Typical examples of the respective residues are represented by the formulae [II], [III], [IV], [V], [VI], [VII], [VIII] and [IX].

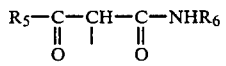

formula [II]

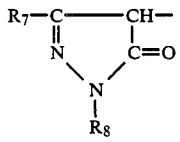

formula [III]

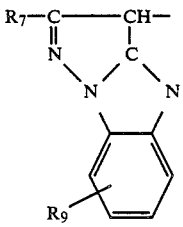

formula [IV]

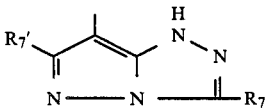

formula [V]

-continued formula [VI]

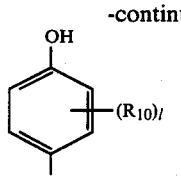

formula [VII]

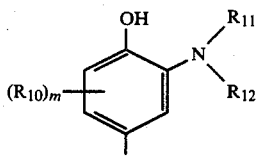

formula [VIII]

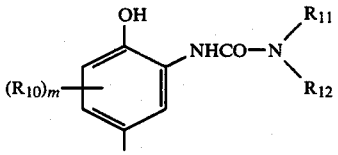

formula [IX]

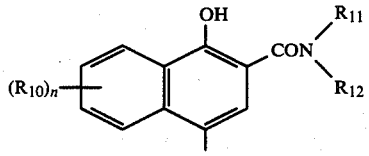

In the above formulae, R5 represents an aliphatic, aromatic or heterocyclic group, and R6 represents an aromatic or heterocyclic group. The aliphatic group represented by R5 should preferably have carbon atoms of 1 to 22, and it may be either substituted or unsubstituted, straight, branched or cyclic. The substituent on the aliphatic group may preferably an alkoxy group, an aryloxy group, an amino group or an acylamino group, and these substituents themselves may further have substituents thereon. Typical examples of R5 which can usefully be used may include the following: isopropyl, isobutyl, tert-butyl, isoamyl, tert-amyl, 1,1-dimethylbutyl, 1,1-dimethylhexyl, 1,1-diethylhexyl, dodecyl, hexadecyl, octadecyl, cyclohexyl, 2-methoxyisopropyl, 2-phenoxyisopropyl, 2-p-tert-butylphenoxyisopropyl, 60-aminoisopropyl, α-(diethylamino)isopropyl, α-(phthalimido)isopropyl, α-(benzenesulfonamido)isopropyl, and the like.

When R5 and $R_6$ represents an aromatic group, particularly a phenyl group, the aromatic group may be substituted. An aromatic group such as a phenyl group may be substituted with a group having not more than 32 carbon atoms such as alkyl, alkenyl, alkoxy, alkoxycarbonyl, alkoxycarbonylamino, aliphatic amide, alkylsulfamoyl, alkylsulfonamide, alkylureido, alkyl-substituted succinimido, etc. In this case, the alkyl group may also have an aromatic group such as phenylene interposed in the chain. The phenyl group may also be substituted with aryloxy, aryloxycarbonyl, arylcarbamoyl, arylamide, arylsulfamoyl, arylsulfonamide, arylureido or other groups, and the aryl moiety of these substituents may further be substituted with one or more of alkyl groups having the total number of carbon atoms of 1 to 22.

The phenyl group represented by R5 or R6 may also be substituted with amino, hydroxy, carboxy, nitro, cyano, thiocyano or a halogen atom, including also those substituted with lower alkyl groups having 1 to 6 carbon atoms.

R5 or R6 may also represent a substituted group in which the phenyl group is fused with another ring, for example, naphthyl, quinolyl, isoquiolyl, curomanyl, cumaranyl, tetrahydronaphthyl, etc. These substituted groups may further have substitutents thereon. The respective alkyl groups as mentioned above may either straight, branched or cyclic.

When R5 or R6 represents a heterocyclic ring, each of heterocyclic ring is bonded through one of carbon atoms forming the ring to the carbon atom of the carbonyl group in the acyl group or the nitrogen atom in the amide group in the alpha-acylacetamide. Such a heterocyclic ring may be inclusive of thiophen, furan, pyran, pyrole, pyrazole, pyridine, pyrazine, pyrimidine, pyridazine, indolizine, imidazole, thiazole, oxazole, triazine, oxazine and the like. These may further have substituents on the ring.

In the formula [III], R8 represents a straight or branched alkyl group having 1 to 40 carbon atoms, preferably 1 to 22 carbon atoms (e.g. methyl, isopropyl, tert-butyl, hexyl, dodecyl, etc.), an alkenyl group (e.g. allyl), a cyclic alkyl group (e.g. cyclopentyl, cyclohexyl, norbornyl), an aralkyl group (e.g. benzyl, β-phenylethyl), a cyclic alkenyl (e.g. cyclopentenyl, cyclohexenyl) and these may be substituted with various groups, including halogen atoms, nitro, cyano, aryl, alkoxyl, aryloxy, carboxy, alkylthiocarbonyl, arylthiocarbonyl, alkoxycarbonyl, aryloxycarbonyl, sulfo, sulfamoyl, carbamoyl, acylamino, diacylamino, ureido, urethane, thiourethane, sulfonamide, heterocyclic, arylsulfonyl, alkylsulfonyl, arylthio, alkylthio, alkylamino, dialkylamino, anilino, N-arylanilino, N-alkylanilino, N-acylanilino, hydroxy, mercapto groups, etc.

Further, R8 may also represent an aryl group (e.g. a phenyl, α- or β-naphthyl). The aryl group may have at least one substituent, which may be selected from alkyl, alkenyl, cyclic alkyl, aralkyl, cyclic alkenyl, halogen atom, nitro, cyano, aryl, alkoxy, aryloxy, carboxy, alkoxycarbonyl, aryloxycarbonyl, sulfo, sulfamoyl, carbamoyl, acylamino, diacylamino, ureido, urethane, sulfonamide, heterocyclic, arylsulfonyl, alkylsulfonyl, arylthio, alkylthio, alkylamino, dialkylamino, anilino, N-alkylanilino, N-arylanilino, N-acylanilino, hydroxy groups and others. More preferably, R8 is a phenyl substituted with at least one substituent at the ortho positions such as alkyl, alkoxy or halogen atoms, and such a compound is useful with little coloration of the coupler remaining in the film by light or heat.

Further, R8 may also represent a heterocyclic group (e.g. a 5-membered or 6-membered heterocyclic ring or fused heterocyclic ring containing a nitrogen atom, oxygen atom or sulfur atom as the hetero atom, such as pyridyl, quinolyl, furyl, benzothiazolyl, oxazolyl, imidazolyl, naphtooxazolyl group, etc.), a heterocyclic group substituted with substituents as enumerated for the above aryl group, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above formulae, R7 and R7′ each represent a hydrogen atom, a straight or branched alkyl having 1 to 40, preferably 1 to 22 carbon atoms, an alkenyl, a cyclic alkyl, an aralkyl, a cyclic alkenyl (these substituents may also have the substituents as enumerated above for R8), an aryl and heterocyclic group (these may have substituents as enumerated above for R8), an alkoxycarbonyl (e.g. methoxycarbonyl, ethoxycarbonyl, stearylcarbonyl, etc.), an aryloxycarbonyl group (e.g. phenoxycarbonyl, naphthoxycarbonyl), an aralkyloxycarbonyl group (e.g. benzyloxylcarbonyl), an alkoxy group (e.g. methoxy, ethoxy, heptadecyloxy), an aryloxy group (e.g. phenoxy, tolyloxy), an alkylthio group (e.g. ethylthio, dodecylthio), an arylthio group (e.g. phenylthio, α-naphthylthio), a carboxy group, an acylamino group (e.g. acetylamino, 3-[(2,4-di-tert-amylphenoxy)acetamido]benzamido), a diacylamino group, a N-alkylacylamino group (e.g. N-methylpropionamide), a N-arylacylamino group (e.g. N-phenylacetamide), a ureido group (e.g. ureido, N-arylureido, N-alkylureido), a urethane group, a thiourethane group, an arylamino group (e.g. phenylamino, N-methylanilino, diphenylamino, N-acetylanilino, 2-chloro-5-tetradecaneamidoanilino, 2-chloro-anilino, 2,4-dichloroanilino, 2-chloro-5-(3-hexadecynylsuccinimido)anilino, etc.), an alkyl amino group (e.g. n-butylamino, methylamino), a cycloamino group (e.g. piperidino, pyrolidino), a heterocyclic amino (e.g. 4-pyridylamino, 2-benzooxazolylamino), an alkylcarbonyl group (e.g. methylcarbonyl), an arylcarbonyl group (e.g. phenylcarbonyl), a sulfonamido group (e.g. alkylsulfonamide, arylsulfonamide), a carbamoyl group (e.g. ethylcarbamoyl, dimethylcarbamoyl, N-methylphenylcarbamoyl, N-phenylcarbamoyl), a sulfamoyl group (e.g. N-alkylsulfamoyl, N,N-dialkylsulfamoyl, N-arylsulfamoyl, N-alkyl-N-arylsulfamol, N,N-diarylsulfamoyl), a cyano group, a hydroxy group or a hydrogen atom.

In the above formulae, R9 represents a straight or branched alkyl group having 1 to 32, preferably 1 to 22 carbon atoms, an alkenyl group, a cyclic alkyl group, an aralkyl group or a cyclic alkenyl group, and these groups may also have substituents as enumerated for the above R8.

Also, R9 may represent an aryl group or a heterocyclic group, and these groups may have substituents as enumerated for the above R8.

Further, R9 may represent other groups such as cyano, alkoxy, aryloxy, halogen atom, carboxy group, alkoxycarbonyl, aryloxycarbonyl, acyloxy, sulfo, sulfamoyl, carbamoyl, acylamino, diacylamino, ureido, urethane, sulfonamide, arylsulfonyl, alkylsulfonyl, arylthio, alkylthio, alkylamino, dialkyl-amino, anilino, N-arylanilino, N-alkylanilino, N-acyl-anilino or hydroxy.

Each of R10, R11 and R12 represents a group used in a conventional tetravalent type phenol or α-naphthol coupler. More specifically, R10 may include a hydrogen atom, a halogen atom, an aliphatic hydrocarbon residue, an acylamino group, a —O—R12 group or a —O—R13 group (where R13 is an aliphatic hydrocarbon residue), and the two or more R10 groups may be identical or different when two or more R10 exist in the same molecule, said aliphatic hydrocarbon residue including those having substituents.

Each of R11 and R12 may represent a group selected from aliphatic hydrocarbon residues, aryl groups and heterocyclic residues, or either one of these may be a hydrogen atom or these groups may have subtituents. Alternatively, R11 and R12 taken together may form a nitrogen containing heterocyclic nucleus. l is an integer of 1 to 4, m an integer of 1 to 3 and n an integer of 1 to 5. And, the aliphatic hydrocarbon residue may be either saturated or unsaturated, and it may also be either straight, branched or cyclic. It is preferably an alkyl group (e.g. methyl, ethyl, propyl, isopropyl, butyl, t-butyl, isobutyl, dodecyl, octadecyl, cyclobutyl, cyclohecyl, etc.), or an alkenyl group (e.g. alkyl, octenyl, etc.). Representatives of the aryl group may be a phenyl and naphthyl, while heterocyclic residue may be typically pyridinyl, quinolyl, thienyl, piperidyl, imidazolyl and the like. The substituents to be introduced into these aliphatic hydrocarbon residues, aryl groups and heterocyclic residues may include halogen atoms, nitro, hydroxy, carboxyl, amino, substituted amino, sulfo, alkyl, alkenyl, aryl, hetero ring, alkoxy, aryloxy, arylthio, arylazo, acylamino, carbamoyl, ester, acyl, acyloxy, sulfonamide, sulfamoyl, sulfonyl, morpholino and others.

The substituents R5, R6, R7, R7', R8, R9, R10, R11 and R12 of the couplers represented by the formulae [II] through [IX] may be bonded to each other, or either one of them may be a divalent group to form a symmetric or asymmetric complex coupler.

Z represents a group eliminable by the reaction between the coupler and the oxidized product of a developing agent, preferably a halogen atom (fluorine, chlorine, bromine, etc.) or a group represented by the following formula [X];

Formula [X]:

—Y—R wherein R represents an alkyl, an aryl, a heterocyclic or A'; A' has the same meaning as A but it may be either the same as or different from A; Y is an atom or a group for linking the coupling active site to R and represents a sulfur atom, a nitrogen atom, an oxygen atom or an alkylene group; and Y and R may be bonded together to form a ring.

The alkyl group represented by R is a straight, branched alkyl having 1 to 32, preferably 1 to 22 carbon atoms, and these may be substituted with substitutents as mentioned above for the aryl groups of R, in addition to aryl groups and vinyl groups.

The aryl group represented by R may be an aryl group having 6 to 36 carbon atoms such as a phenyl group or a naphthyl group, and these groups may be substituted with substituents, including halogen atoms, nitro, cyano, alkoxy, aryloxy, carboxy, alkylcarbonyl, arylcarbonyl, alkoxycarbonyl, aryloxycarbonyl, acyloxy, sulfamoyl, carbamoyl, acylamino, diacylamino, ureido, alkoxycarbonylamino, aryloxycarbonylamino, heterocyclic ring, arylsulfonyloxy, alkylsulfonyloxy, arylthio, alkylthio, alkylamino, dialkylamino, anilino, N-acylanilino, hydroxy groups and others (the alkyl moiety of these substituents having preferably 1 to 22 carbon atoms, and it may be either straight, branched or cyclic, and the aryl moiety having preferably 6 to 22 carbon atoms).

The heterocyclic ring group represented by R may be exemplified by the groups shown below:

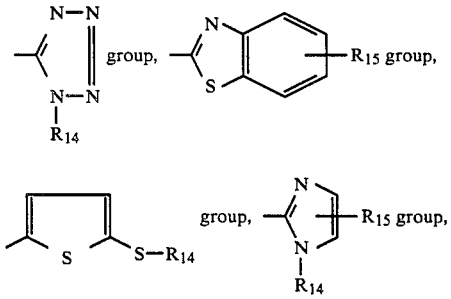

-continued

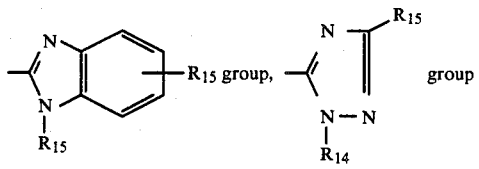

In the above formulae, R14 represents a hydrogen atom, an alkyl group having 1 to 22 carbon atoms or an aryl group having 6 to 28 carbon atoms, which may be substituted with a substituent as mentioned for the aryl group of the above R. On the other hand, R15 represents a hydrogen atom, an alkyl having 1 to 22 carbon atoms (either straight, branched or cyclic), an aryl group having 6 to 28 carbon atoms (these may be substituted with substituents as mentioned for the aryl of the above R), a halogen atom, nitro, cyanol, an alkoxy, an aryloxy, an alkylcarbonyl, an arylcarbonyl, an alkoxycarbonyl, an aryloxycarbonyl, an acyloxyl, a sulfamoyl, a carbamoyl, an acylamino, a diacylamino, an alkoxycarbonylamino, an aryloxycarbonyl-amino, an arylthio, an alkylthio, an alkylamino, a dialyklamino, an anilino, a N-acylanilino or a hydroxy group (the alkyl moiety of these groups having preferably 1 to 22 carbon atoms).

In the formula [X], Y represents a sulfur atom, a nitrogen atom, an oxygen atom or an alkylene group, and the alkylene group may be substitued with the same sibstituents as mentioned for the aryl group of the above R. Also, preferably, when Y is an alkylene group, R should preferably be a coupler residue having the same meaning as defined by A (A and R may be either identical or different).

Further, Y may also be substituted with other coupler residues other than A and R (which may be either the same as or different from A or R).

The alkylene group may preferably a methylene group.

In the formula [X], the ring formed by bonding of R and Y may preferably a group represented by the formula [XI] shown below:

Formula [XI]:

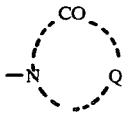

wherein Q represents a group of atoms necessary for forming a 4- to 6-membered ring.

The groups represented by the formula [XI] include the following:

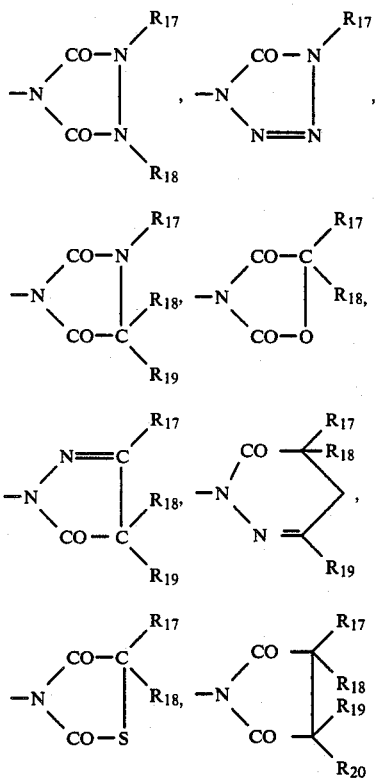

In the above formula R17, R18, R19 and R20 have the same meaning as defined by the above R15, and R17 to R20 may be either the same or different from each other.

Examples of the divalent couplers preferably used in the present invention are enumerated below, but the present invention is not limited thereto.

[Exemplary compounds]

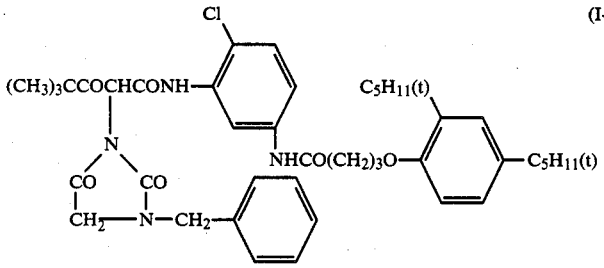

(I-1)

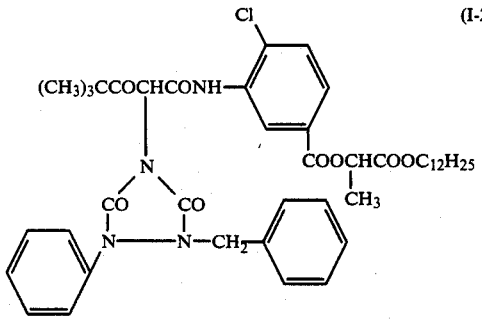

(I-2)

-continued
(I-3)
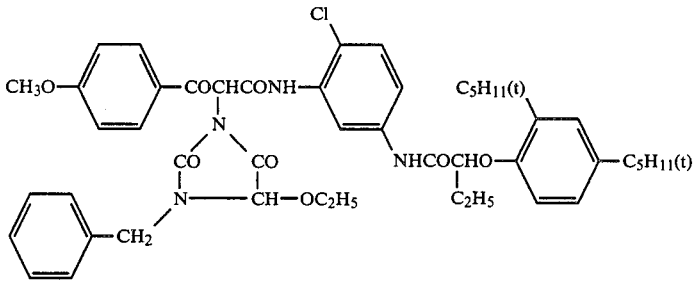
(I-4)
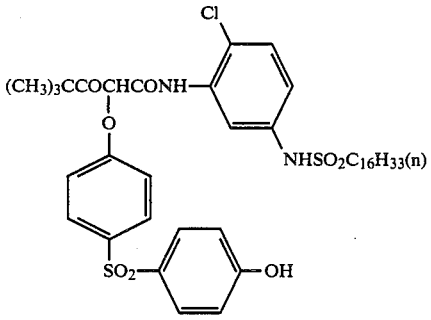
(I-5)
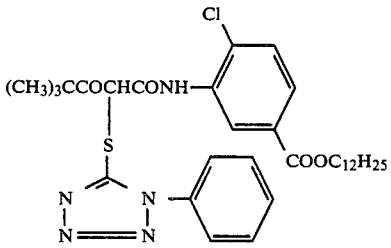
(I-6)
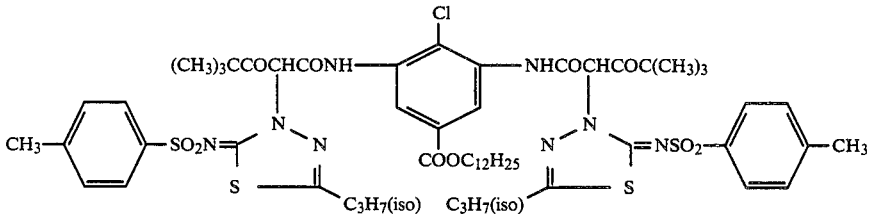
(I-7)
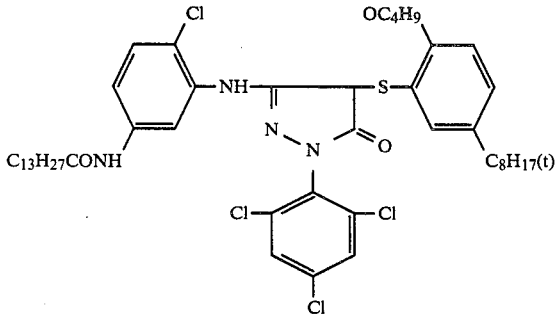
(I-8)
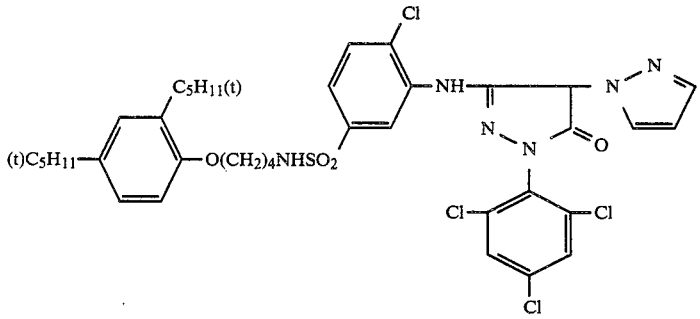

-continued
(I-9)
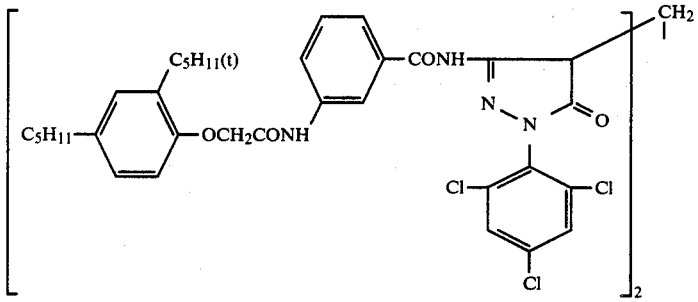
(I-10)
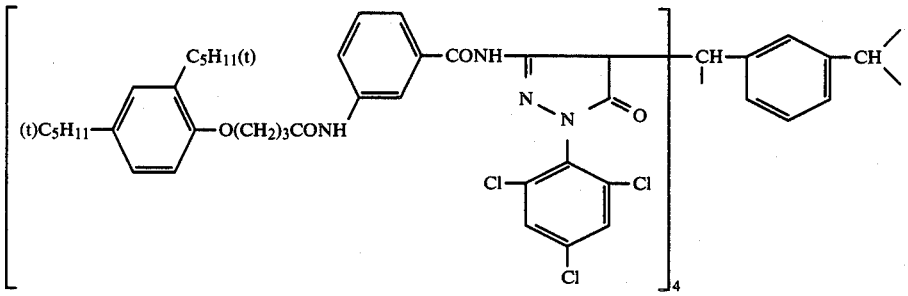
(I-11)
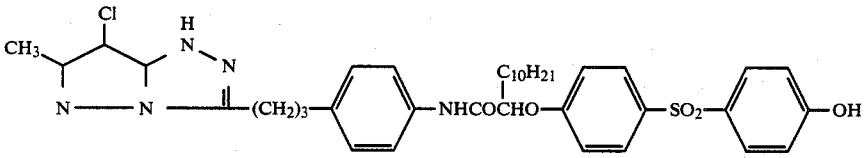
(I-12)
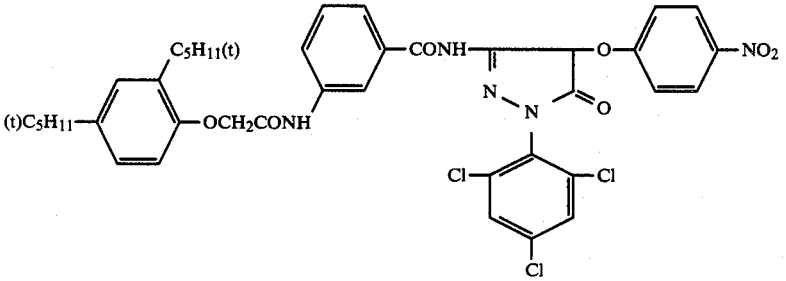
(I-13)
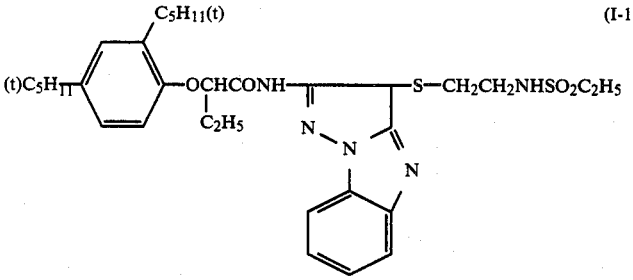
(I-14)
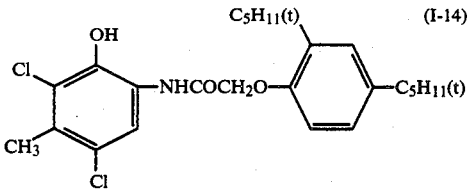
(I-15)
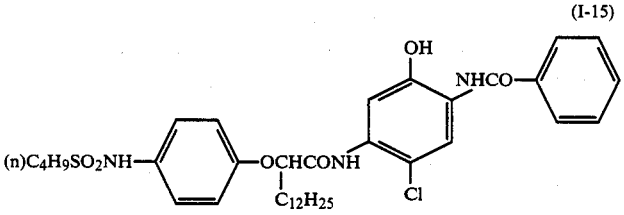
(I-16)
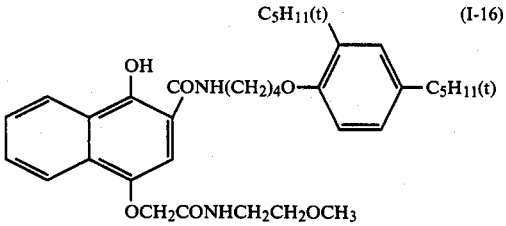

-continued
(I-17)
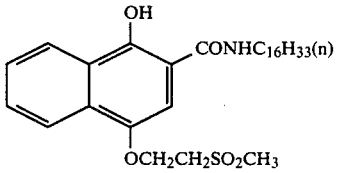
(I-18)
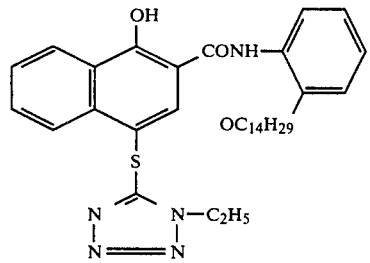
(I-19)
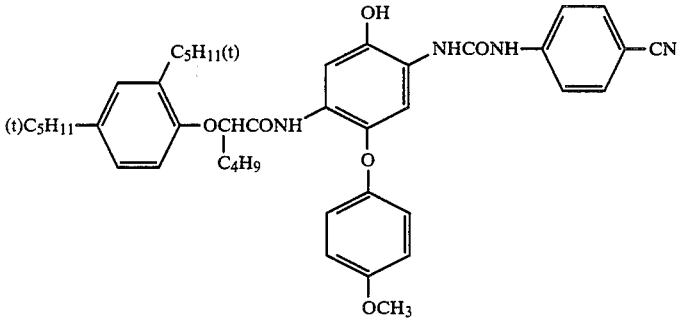
(I-20)
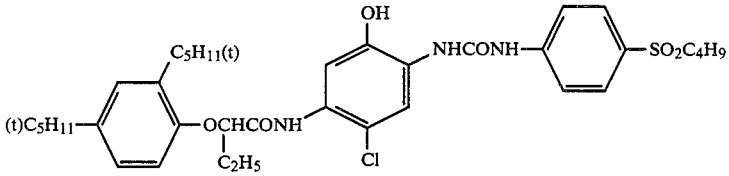
(I-21)
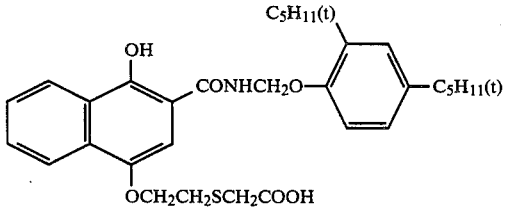
(I-22)
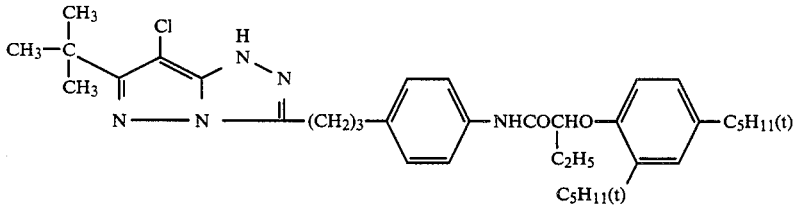
The color developing agent to be used in the present invention is a para-phenylenediamine type color developing agent having at least one water soluble group (hydrophilic group) on its amino group, and typical examples of these color developing agents are enumerated, but the present invention is not limited thereto.
(1)
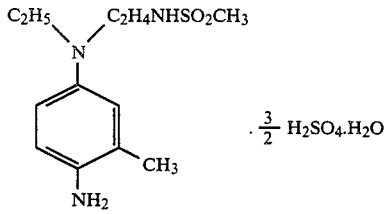
-continued
(2)
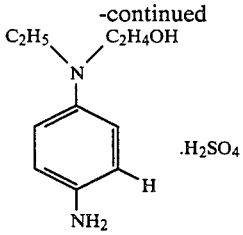

-continued (3)

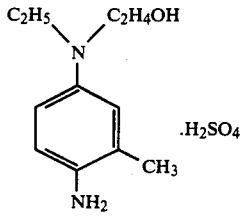

(4)

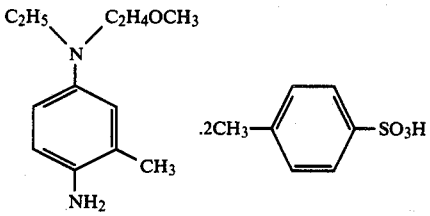

(5)

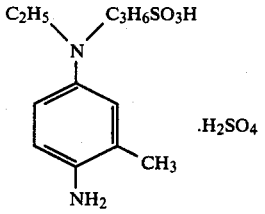

(6)

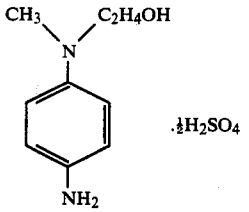

(7)

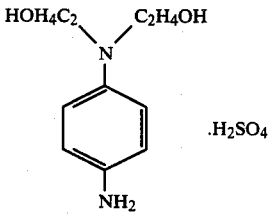

(8)

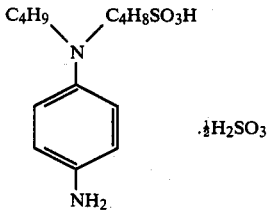

(9)

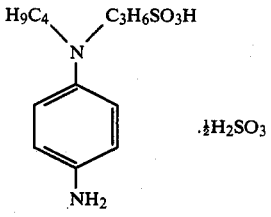

-continued (10)

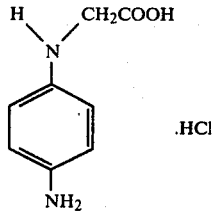

(11)

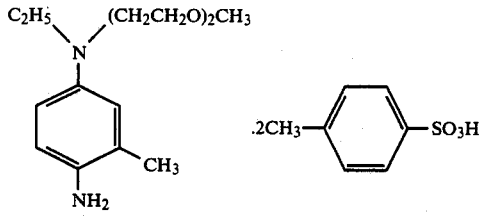

(12)

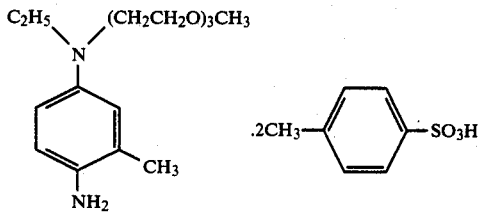

(13)

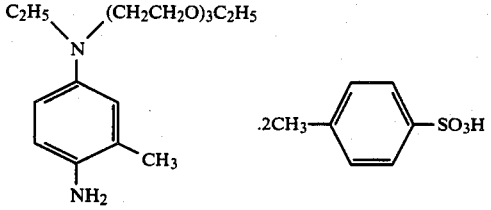

(14)

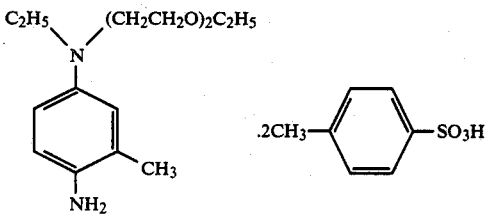

The color developing agents particularly useful in the present invention are compounds having, as a substituent on its amino group, groups such as $-(CH_2)_n-CH_2OH$, $-(CH_2)_m-NHSO_2-(CH_2)_n-CH_3$ and $-(CH_2)_m-O-(CH_2)_n-CH_3$, and specific compounds may include the above examples of (1), (2), (3), (4), (6) and (7). In the above formulae, m and n are integers of 0 or more, preferably 0 to 5.

In this invention, a bleach-fixing solution is kept in a state of being oxidized, preferably is accompanied with oxidation treatment, and more preferably is subjected to air oxidation. Here, the air oxidation refers preferably to a compulsory oxidation step, in which oxidation is performed by introducing compulsorily air bubbles into a bleaching liquor tank or a bleach-fixing liquor tank of an automatic developing machine to be mixed and contacted with the liquid. This means is generally called aeration, and the air delivered from a device such as a compressor is made into sizes as small as possible through a diffusion instrument having minute holes such as an air distributor for the purpose of enhancing oxidation efficiency, thereby making the contact area with the liquid greater, and oxidation is effected through contact of the air bubbles delivered into the liquid through the bottom of the tank with the processing with the liquid being great, and oxidation is effected through contact of the air bubbles delivered into the liquid through the bottom of the tank with the processing solution.

This aeration is performed primarily in a processing tank but it may also be performed batchwise in a separate tank or alternatively in a sub-tank for aeration equipped on the side of the tank. In particular, when regeneration of a bleaching solution or regeneration of a bleach-fixing solution is to be performed, aeration should preferably be conducted outside of the tank liquid. In the present invention, since overaeration is ordinarily not conceivable, aeration may be conducted through all the processing time, or strong aeration may be conducted intermittently, or any other desired method may be employed. However, the bubble sizes of the air should preferably be as small as possible for the purpose of efficiency as well as for prevention of entrainment of the liquid into another liquid. In the present invention, it is also preferred to use the method in which aeration is conducted during stopping of the automatic developing machine, and aeration is stopped during processing. Aeration may also be conducted separately by leading the liquid to a place outside of the processing tank. Such aeration may be used in combination with the showering system, spraying system and jet atomizing system as disclosed in Japanese Unexamined Patent Publications Nos. 55336/1974, 9831/1976 and 95234/1979, and also the method as disclosed in German Patent (DT) 2113651 may be used.

The air oxidation used herein includes, in addition to the above mentioned compulsory oxidation or aeration, also an air oxidation in which the oxidation of the solution is effected by natural contact with air in such a manner that the contact area thereof is made greater than the predetermined area, preferably 6 $cm^2$/liter or more.

The diethylenetriaminepentaacetic acid iron (III) complex may be free acid, but generally employed as the salt selected from sodium salt, potassium salt and ammonium salt. Generally speaking, the ammonium salt is preferable for stable buffer action, and as other than the above salts, water-soluble amine salts, particularly the triethanolamine salt may also be available. These may be used either singly or as a combination of two or more compounds. It can be used in an amount which can be selected widely as desired, and it is required to select the amount depending on the silver quantity and the silver halide composition of the light-sensitive material to be processed, but it can be used generally at a lower concentration than other aminopolycarboxylic acid salts due to its higher oxidative power. For example, it can be used at a level of 0.01 mole or higher, preferably 0.05 mole or higher, per liter of the solution employed. In the supplemental solution, for supplementing concentrated solution at low level, it is desirable to make the solution concentrated as high as possible to the limit of solubility. It is also possible to provide a pretreatment bath and incorporate the diethylenetriamine pentaacetic acid iron (III) complex in this bath so that the amount brought into and accumulated in the bleaching bath or the bleach-fixing bath may become the above concentration.

The bleach-fixing solution of the present invention may be used as pH 0.2 to 9.5, preferably 4.0 or higher, more preferably 5.0 or higher. The most preferred pH range is from 5.0 to 9.5. The temperature for processing should preferably be 80° C. or lower, but it is more preferable to use a temperature of 55° C. or lower in order to suppress evaporation, etc.

As the bleach-fixing solution of the present invention, there may be employed a solution with a composition, containing a diethylenetriaminepentaacetic acid iron (III) complex as the bleaching agent as described above and also a silver halide fixing agent such as a thiosulfate, thiocyanate, thiourea, thioether, etc. It is also possible to use a bleach-fixing solution with a composition in which a small amount of a halide such as potassium bromide is added in addition to the bleaching agent of the present invention and the above-mentioned silver halide fixing agent, or a bleach-fixing solution with a composition in which contrariwise a large amount of a halide such as potassium bromide or ammonium bromide is added, or a special bleach-fixing solution with a composition comprising a combination with a large amount of a halide such as potassium bromide, etc.

The halides may include, in addition to potassium bromide, hydrochloric acid, hydobromic acid, lithium bromide, sodium bromide, ammonium bromide, sodium iodide, potassium iodide, ammonium iodide and the like.

The silver halide fixing agent to be contained in the bleach-fixing solution may be a compound which can form a waster-soluble complex through the reaction with a silver halide as used in conventional fixing processing, including, for example, thiosulfates such as potassium thiosulfate, sodium thiosulfate and ammonium thiosulfate, thiocyanates such as potassium thiocyanate, sodium thiocyanate and ammonium thiocyanate, or thiourea, thioether, highly concentrated bromide and iodide. These fixing agents may be employed in amounts of 5 g/liter or more up to the limit which can be dissolved.

The bleach-fixing solution can also incorporate pH buffering agents or controllers comprising various kinds of salts of boric acid, borax, sodium hydroxide, potassium hydroxide, sodium carbonate, potassium carbonate, sodium bicarbonate, potassium bicarbonate, acetic acid, sodium acetate, ammonium hydroxide, etc., singly, or in combination with two or more kinds thereof. Further, various fluorescent whitening agents, defoaming agents or surfactants may also be present.

It is also possible to incorporate optionally preservatives such as hydroxylamine, hydrazine, sulfites, metabisulfites, bisulfite adducts of aldehyde or ketone compounds, etc. or stabilizers such as nitroalcohol, nitrate, etc., solubilizers such as alkanolamine, etc., stain preventives such as organic amines, other additives or organic solvents such as methanol, dimethylformamide, dimethyl sulfoxide, etc.

In the present invention, it is preferred to carry out bleach-fixing processing at a percentage of the color developer brought into the bleach-fixing solution (hereinafter called as the contamination percentage) of 2% or more of the bleach-fixing solution of the present invention, whereby desilverization is clearly improved, and further marked improvement of desilverization effect is observed when the contamination becomes 3.5% or higher.

For the purpose of carrying out the oxidation processing more effectively, it is very useful to incorporate various additives. Such additives may include organic acids such as aminopolycarboxylic acids, aminopolyphosphonic acids, oxycarboxylic acids, etc. and metal complexes of these organic acids, and such metal complexes may be formed in the bleach-fixing solution by adding separately metal salts and organic acids.

The metal ions which can be used in combination with these organic acids may include the following.

(A-1) iron;
(A-2) nickel;
(A-3) cobalt;
(A-4) zinc;
(A-5) cerium;
(A-6) ruthenium;
(A-7) yttrium;
(A-8) samarium;
(A-9) magnesium;
(A-10) calcium;
(A-11) bismuth;
(A-12) strontium
(A-13) manganese;
(A-14) aluminum;
(A-15) tin;
(A-16) barium;
(A-17) indium;
(A-18) thallium; and
(A-16) zirconium.

These metal ions may be added as metal complexes of organic acids or they can be added in the bleach-fixing solution in the form of chlorides, bromides, nitrates, sulfates, acetates, phosphates, etc. together with organic acids to form complexes therewith in the bleach-fixing solution.

The organic acids may include those represented by the following formula [XII] or [XIII]:

Formula [XII]

$$X_1-A_1-Z_1-A_2-X_2$$

Formula [XIII]

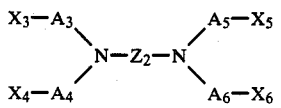

wherein $A_1$, $A_2$, $A_3$, $A_4$, $A_5$ and $A_6$ each represent a substituted or unsubstituted hydrocarbon group, $Z_1$ and $Z_2$ each represent a substituted or unsubstituted hydrocarbon group, a hydrocarbon group containing an ether group or a group of the formula:

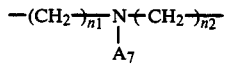

[$n_1$ and $n_2$ each represent an integer of 1 to 3 and $A_7$ represents $-(CH_2)_{n3}X_7$ (where $n_3$ is an integer of 0 to 3 and $X_7$ is a hydrogen atom, a carboxylic acid group, a hydroxyl group or a phosphonic acid group)]; and $X_1$, $X_2$, $X_3$, $X_4$, $X_5$ and $X_6$ each represent a carboxylic acid group, a hydroxyl group or a phosphonic acid group.

These organic acids may be in forms of alkali metal salts, ammonium salts or water-soluble amine salts.

Of the organic acids represented by the above formula [XII] or [XIII], those which can be added without combination with metal ions to give a high effect are organic acids shown by (B-1) to (B-8) shown below:

(B-1) Ethylenediaminetetraacetic acid;
(B-2) Trans-1,2-cyclohexanediaminetetraacetic acid;
(B-3) 1,3-Diaminopropane-2-ol-tetraacetic acid;
(B-4) Ethylenediamine-di(o-hydroxyphenylacetic acid);
(B-5) Glycoletherdiaminetetraacetic acid;
(B-6) 1,2-Diaminopropanetetraacetic acid;
(B-7) N-hydroxyethylethylenediaminetriacetic acid;
(B-8) Triethylenetetraminehexaacetic acid;

These organic acids may be used in combination with the salts of the metal ions shown by the above (A-1) to (A-19) or as metal complexes of these ions, but it is particularly preferable to add these organic acids as iron (III) complexes.

Organic acids which can exhibit high effect when combined with the above metal ions of (A-1) to (A-19) are following organic acids (B-9) - (B-19).

(B-9) Dihydroxyethylglycine;
(B-10) Iminodiacetic acid;
(B-11) Methyliminodiacetic acid;
(B-12) Ethyliminodiacetic acid;
(B-13) Butyliminodiacetic acid;
(B-14) Hydroxyethyliminodiacetic acid;
(B-15) Nitrilotriacetic acid;
(B-16) Nitrilodiaceticpropionic acid;
(B-17) Nitrilotripropionic acid;
(B-18) Ethylenediaminediacetic acid; and
(B-19) Ethylenediaminedipropionic acid.

These organic acids should preferably be employed in combination with the salts of metal ions (A-2), (A-3), (A-4), (A-5), (A-6), (A-9), (A-10), (A-11), (A-13) and (A-14) or as metal complexes of these ions.

It is also possible to use a combination of two or more cases selected from an organic acid, an organic acid metal complex and a combination of an organic acid with a metal salt. Its amount may preferably be from 0.0001 to 2 mole/liter, particularly preferably from 0.001 to 1 mole/liter.

As the additives to be used for further effective air oxidation treatment of the present invention, the bleaching accelerating agents shown by the following formulae [XIV]-[XVIII] may be included.

Formula [XIV] Formula [V] Formula [XVI]

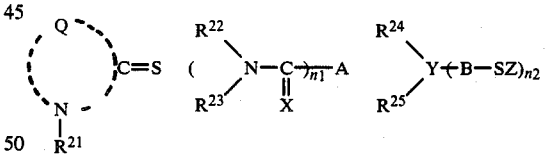

Formula [XVII] Formula [XVIII]

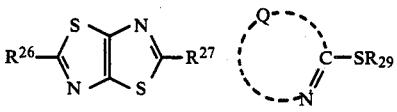

In the above formulae, Q represents a group of atoms necessary for forming a hetero ring containing at least one N atom (including rings in which a 5- to 6-membered unsaturated ring is fused thereto);

A represents

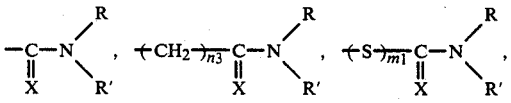

-continued

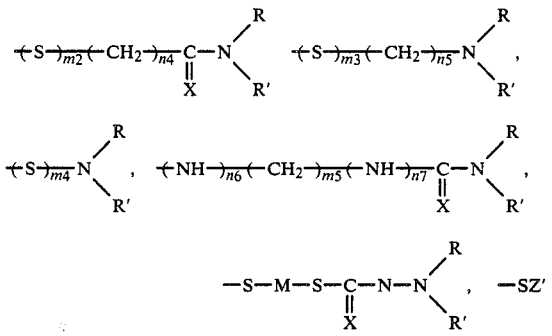

or a $n_1$-valent heterocyclic residue (inclusive of those in which at least 5- to 6-membered unsaturated ring is fused thereto);

B represents an alkylene group having 1 to 6 carbon atoms;

M represents a divalent metal atom;

X represents =S, =O or =NR";

R" represents a hydrogen atom, an alkyl having 1 to 6 carbon atoms, a cycloalkyl, an aryl, a heterocyclic residue (to which at least one 5- to 6-membered ring may be fused) or an amino group;

Y represents >N— or >CH—;

Z represents a hydrogen atom, an alkali metal atom, an ammonium group, an amino group or a nitrogen-containing heterocyclic residue;

Z' represents Z or an alkyl;

$R^{21}$ represents a hydrogen atom, an alkyl having 1 to 6 carbon atoms, a cycloalkyl, an aryl, a heterocyclic residue (inclusive of those in which at least one 5- to 6-membered ring is fused thereto) or an amino group;

$R^{22}$, $R^{23}$, $R^{24}$, $R^{25}$, R and R' each represent a hydrogen atom, an alkyl having 1 to 6 carbon atoms, a hydroxy, a carboxy, an amino, an acyl having 1 to 3 carbon atoms, an aryl or an alkenyl, with proviso that R and R', $R^{22}$ and $R^{23}$, and $R^{24}$ and $R^{25}$, respectively, may be cyclized together to form a heterocyclic residue (inclusive of those in which at least one 5- to 6-membered ring is fused thereto);

$R^{26}$ and $R^{27}$ each represent a group of the formula:

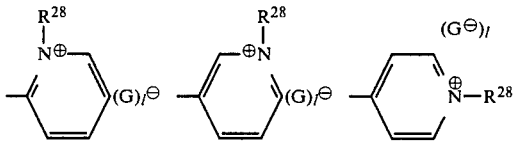

wherein $R^{28}$ represents an alkyl or $-(CH_2)_{n8}SO_3^-$ (when $R^{28}$ is $-(CH_2)_{n8}SO_3^-$, l is 0 or 1), $G^{\ominus}$ represents an anion, $m_1$ through $m_4$ and $n_1$ through $n_8$ each represent an integer of 1 to 6, $m_5$ is an integer of 0 to 6;

$R^{29}$ represents a hydrogen atom, an alkali metal atom, a group of the formula:

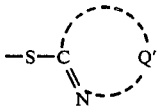

or an alkyl group (wherein Q' is the same as Q as defined above);

the compounds represented by the above formulae including enolized products and salts thereof.

The heterocyclic residues, amino groups, aryl groups, alkenyl groups and alkylene groups as represented by $R^{11}$, $R^{12}$, $R^{13}$, $R^{14}$, $R^{15}$, $R^{28}$, $R^{29}$, A, B, Z, Z', R, R' and formed by R and R', $R^{22}$ and $R^{23}$, $R^{24}$ and $R^{25}$, and Q, Q', may be substituted, respectively. Substituents may include alkyl, aryl, alkenyl, cyclic alkyl, aralkyl, cyclic alkenyl, halogen atom, nitro, cyano, alkoxy, aryloxyl, carboxyl, alkoxycarbonyl, aryloxycarbonyl, sulfo, sulfamoyl, carbamoyl, acylamino, heterocyclic residue, arylsulfonyl, alkylsulfonyl, alkylamino, dialkylamino, anilino, N-alkylanilino, N-arylanilino, N-acylanilino, hydroxyl and others. The alkyl group represented by the above $R^{21}$ through $R^{25}$, $R^{28}$, $R^{29}$, A, B, Z, Z', R and R' may also have substituents, which may include those as mentioned above except for alkyl groups.

Typical examples of the above compounds may include those as enumerated below, but the present invention is not limited thereto.

[Exemplary compounds]

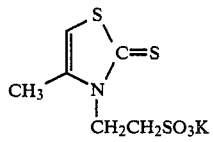

(XIV-1)

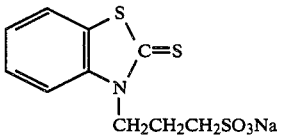

(XIV-2)

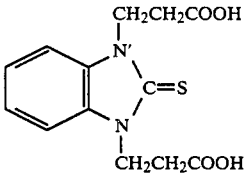

(XIV-3)

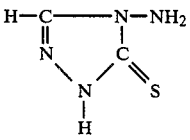

(XIV-4)

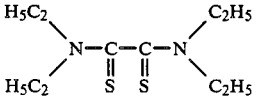

(XV-1)

$H_2N-CSNHNHCS-NH_2$ (XV-2)

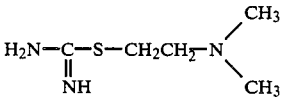

(XV-3)

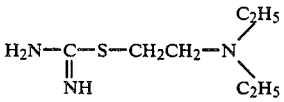

(XV-4)

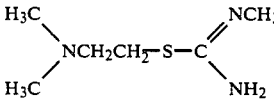

(XV-5)

(I)

-continued (XVI-1)

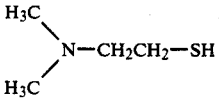

(XVI-2)

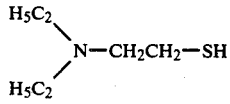

(XVI-3) HOOC.CH$_2$CH$_2$.SH (XVI-4)

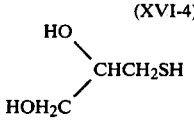

(VII-1)

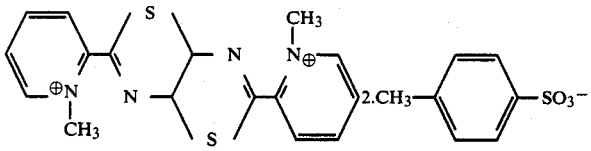

(VII-2)

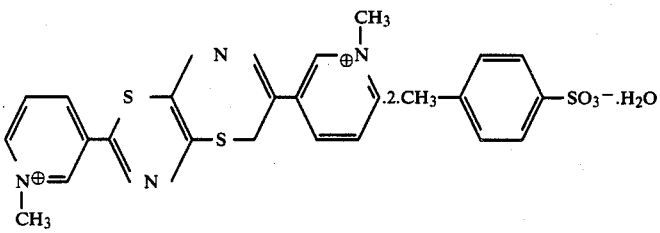

(VII-3)

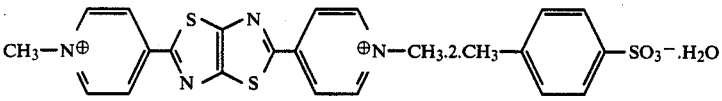

(VII-4)

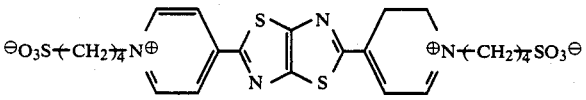

(XVIII-1)

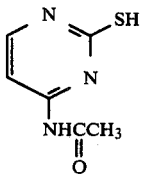

(XVIII-2)

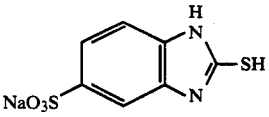

(XVIII-3)

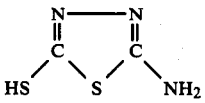

(XVIII-4)

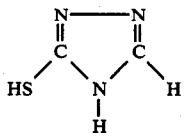

The above compounds are all known and can be synthesized easily according to the known synthetic methods.

The bleaching accelerating agent may be present in bleaching of the silver image obtained by developing, and it is preferred to employ the method in which it is added into a bleaching bath or bleach-fixing bath, or alternatively it may be added to a bath prior to the bleaching bath or bleach-fixing bath to be included in the light-sensitive material, thereby being incorporated in the bleaching bath or the bleach-fixing bath. It is also possible to incorporate previously in the light-sensitive material during manufacturing, followed by dissolving out into the bleaching bath or the bleach-fixing bath.

These bleaching accelerating agents may be used individually or as a combination of two or more compounds, and the amount of such an accelerating agent to be added into the bleaching bath or the bleach-fixing bath or into a bath preceding those baths may be generally about 0.01 to 100 g per liter of the processing solution to give good results. However, generally speaking, if the amount added is small, the bleaching accelerating effect is small, while an amount greater than necessary may result in formation of precipitation to contaminate the light-sensitive photographic material to be processed. Thus, it is preferred to employ an amount of 0.1 to 50 g per liter of the processing solution, more preferably 0.1 to 30 g/liter, most preferably 0.1 to 15 g/liter.

When the bleaching accelerating agent is to be added into the processing solution, it may be added and dissolved therein as such, but it is generally practiced to dissolve previously in water, an alkali or an organic acid before addition, and there is no influence at all on the bleaching (fixing) effect of such an agent even when added, if desired, as a solution in an organic solvent.

Direct processing with a bleach-fixing solution after color developing as herein mentioned means processing in a processing bath having a fixing action, excluding a stopping bath, washing bath and bleaching bath, but the case such as rinsing with a small amount of washing water or stopping solution is not excluded.

After bleach-fixing, stabilizing processing may be performed substantially without water washing, or water washing processing may also be conducted before stabilizing processing. In addition to the above steps, auxiliary steps already known such as film hardening, neutralization, black-and-white developing, reversal, the step of washing with a small amount of water, etc. may be added, if desired. Typical examples of preferable processing methods may include the combinations of various steps as shown below.

(1) Color developing→Bleach-fixing→Water washing (2) Color developing→Bleach-fixing→Water washing Stabilizing
(3) Color developing→Bleach-fixing→Stabilizing
(4) Color developing→Fixing→Bleach-fixing Stabilizing
(5) Black-and-white developing→Water washing Reversal→Color developing→Bleach-fixing Water washing→Stabilizing
(6) Pre-film hardening→Neutralization→Black-and-white developing→Stopping→Color developing Bleach-fixing→Water washing→Stabilizing.

The black-and-white developer to be used prior to processing with the bleach-fixing processing solution of the present invention may be the so called black-and-white first developer which is used for processing generally known light-sensitive color photographic material or one which is used for processing monochromatic light-sensitive photographic material, and various additives which can generally be added in the black-and-white developer may be contained therein.

Typical additives may include developing agents such as 1-phenyl-3-pyrazolidone, Metol and hydroquinone, preservatives such as sulfites, accelerators comprising an alkali such as sodium hydroxide, sodium carbonate, potassium carbonate, etc., inorganic or organic suppressors such as potassium bromide, 2-methylbenzimidazole, methylbenzthiazole, etc., hard water softeners such as polyphosphoric acid salts, surface overdeveloping preventives comprising a minute amount of an iodide or an mercapto compound, etc.

The alkaline color developing solution to be used prior to processing with the bleach-fixing solution of the present invention may further optionally contain, in addition to the p-phenylenediamine type color developing agent of the present invention as described above, various components conventionally added in color developing solutions, for example, alkali agents such as sodium hydroxide, sodium carbonate, potassium carbonate, etc., water softeners or thickeners such as alkali metal sulfites, alkali metal bisulfites, alkali metal thiocyanates, alkali metal halides, benzyl alcohol, diethylenetriaminepentaacetic acid, 1-hydroxyethylidene-1,1-diphosphonic acid and others. The pH value of this color developing solution is generally 7 or more, most generally from about 10 to about 13. The silver halide emulsion which can be used may be one employing any of silver chloride, silver bromide, silver iodide, silver chlorobromide, silver chloroiodide, silver iodobromide, silver chloroiodobromide, or a mixture of these. As the protective colloid for these silver halide, natural product such as gelatin or various materials obtained by synthesis can be used. The silver halide emulsion may also contain conventional additives for photography such as stabilizers, sensitizers, film hardeners, sensitizing dyes, surfactants, etc.

The processing method of the present invention may be applicable for light-sensitive silver halide color photographic materials such as color paper, color nega film, color posi film, color reversal film for slide, color reversal film for movie, color reversal film for TV and reversal color paper.

The present invention is described in detail below by referring to the following Examples, by which the embodiments of the present invention are not limited.

EXAMPLE-1

On a triacetate film base were provided a halation preventive layer and a gelatin layer, followed by coating thereon with a red-sensitive silver halide emulsion layer, a green-sensitive silver halide emulsion layer, a filter layer containing yellow colloidal silver and a blue-sensitive silver halide emulsion layer to the total quantity of silver of 96 mg/100 $cm^2$. In the blue-sensitive silver halide emulsion layer was employed the above I-(2) as the yellow coupler, in the green-sensitive silver halide layer the above I-(7) as the magenta coupler, in the red-sensitive silver halide emulsion layer the above I-(17) as the cyan coupler, and in each emulsion were added conventional additives such as sensitizing dye, film hardener and extender. The thus obtained light-sensitive silver halide color nega material was employed as the sample.

After photographing with this sample by Konica FS-1 camera (produced by Konishiroku Photo Industry Co.), processings were performed by use of a processing device for piece following the following steps (hereinafter called as manual developing process).

| Processing step (38° C.) | Number of tanks | Processing time |
|---|---|---|
| Color developing | 1 | 3 min. 15 sec. |
| Bleach-fixing | 1 | 8 min. 40 sec. |
| Water washing | 2 | 4 min. 20 sec. |
| Stabilizing | 1 | 2 min. 10 sec. |

The processing solutions employed had the following compositions:

[Color developing solution]

| | |
|---|---|
| Potassium carbonate | 30 g |
| Sodium hydrogen carbonate | 2.5 g |
| Potassium sulite | 5 g |
| Sodium bromide | 1.3 g |
| Potassium iodide | 2 mg |
| Hydroxylamine sulfate | 2.5 g |
| Sodium chloride | 0.6 g |
| Sodium diethylenetriaminepentaacetate | 2.5 g |
| Color developing agent shown in Table 1 | 4.5 g |
| Potassium hydroxide | 1.2 g |
| (made up to one liter with addition of water, and adjusted to pH 10.06 with potassium hydroxide or 20% sulfuric acid). | |

[Bleach-fixing solution (1)]

| | |
|---|---|
| Ammonium ferric ethylenediaminetetraacetate dihydrate | 120 g |
| Ethylenediaminetetraacetic acid | 18 g |
| Ammonium thiosulfate (70% solution) | 300 ml |
| Ammonium sulfite (40% solution) | 40 ml |
| Color developing agent shown in Table 1 | 100 ml |
| Silver powder | 1.2 g |
| (adjusted to pH 6.8 with aqueous ammonia, and the total quantity made up to one liter with addition of water). | |

[Bleach-fixing solution (2) (bleach-fixing solution of this invention]

| | |
|---|---|
| Ammonium ferric diethylenetriaminepentaacetate | 142 g |
| Diethylenetriaminepentaacetic acid | 24 g |
| Ammonium thiosulfate (70% solution) | 300 ml |
| Ammonium sulfite (40% solution) | 40 ml |
| Color developing agent shown in Table 1 | 100 ml |
| Silver powder | 1.2 g |
| (adjusted to pH 6.8 with aqueous ammonia, and the total quantity made up to one liter with addition of water). | |

[Stabilizing solution]

| | |
|---|---|
| Formalin (37% aqueous solution) | 2 ml |
| Konidax (produced by Konishiroku Photo Industry Co.) | 5 ml |
| (made up to one liter with addition of water). | |

The bleach-fixing solution was stored one day and then subjected to air oxidation by arranging an air spurger made of a sintered metal with pore sizes of 50 μm and feeding the air at a rate of 2.0 liter/min. per liter of bleach-fixing solution for period shown in Table 1, before it was provided for use in processing.

After processing, the minimum green density (magenta stain) obtained by subtracting the green density due to residual silver and the maximum red density (cyan dye density) were measured to obtain the results as shown in Table 1.

For comparison, the sample processed by Sakura Color Nega Process CNK-4 which is a standard processing was also similarly measured. However, the desilverization processing time was 6 minutes and 30 seconds for bleaching processing and 6 minutes and 30 seconds for fixing processing.

according to the processing method in which color developing agents or bleach-fixing solutions outside the scope of the present invention are combined (Sample No. 1 to 10), but stain was gradually increased after 30 hours until marked increase was observed after 60 hours. In contrast, according to the processing method of the present invention (Sample No. 11-14), namely by processing with a color developing agent of a p-phenylenediamine having a water-soluble group on the amino group and thereafter carrying out bleach-fixing processing with a diethylenetriaminepentaacetic iron (III) complex as the bleaching agent, no such marked increase as in the processing method other than the present invention was observed at all even after 60 hours of aeration, although a slight increase of stain was recognized. In Sample 1, 4 or 7 which has not been subjected to air oxidation, the rate of increase in stain generation is slight but the color restoration percentage is inferior to that of the Samples of the present invention. Evaluation of the cyan stain (minimum red density) and yellow stain (minimum blue density) gave the same results as in the case of magenta stain.

Color restoration was also evaluated at the aeration

TABLE 1

| Sample No. | Color developing agent | Bleach-fixing solution | Air oxidation: air quantity/liter of bleach-fixing solution | Aeration time (bleach-fixing solution) 0: Stain (minimum green density) | 0: Color restoration (%) | 3 hrs Stain | 10 hrs Stain | 30 hrs Stain | 60 hrs Stain | 60 hrs Color restoration (%) |
|---|---|---|---|---|---|---|---|---|---|---|
| 1 | Control (1) | (1) | none | 0.48 | 79 | 0.47 | 0.48 | 0.50 | 0.55 | 94 |
| 2 | " | " | 2 l/min | 0.48 | 79 | 0.47 | 0.54 | 0.70 | 1.09 | 99 |
| 3 | Control (2) | " | " | 0.49 | 80 | 0.47 | 0.53 | 0.68 | 1.03 | 101 |
| 4 | Exemplary compound (3) | " | none | 0.47 | 79 | 0.48 | 0.49 | 0.51 | 0.53 | 96 |
| 5 | Exemplary compound (3) | " | 2 l/min | 0.49 | 79 | 0.47 | 0.52 | 0.64 | 0.98 | >100 |
| 6 | Exemplary compound (4) | " | " | 0.48 | 81 | 0.48 | 0.52 | 0.65 | 1.00 | 99 |
| 7 | Control (1) | (2) | none | 0.45 | 85 | 0.46 | 0.46 | 0.47 | 0.50 | 90 |
| 8 | " | " | 2 l/min | 0.47 | 85 | 0.47 | 0.50 | 0.60 | 0.95 | 98 |
| 9 | Control (2) | " | " | 0.48 | 87 | 0.44 | 0.49 | 0.58 | 0.93 | 99 |
| 10 | Exemplary compound (3) | " | none | 0.46 | 88 | 0.46 | 0.46 | 0.46 | 0.49 | 91 |
| 11 | Exemplary compound (3) | " | 2 l/min | 0.46 | 88 | 0.46 | 0.47 | 0.49 | 0.53 | 109 |
| 12 | Exemplary compound (4) | " | " | 0.48 | 87 | 0.48 | 0.50 | 0.51 | 0.54 | 108 |
| 13 | Exemplary compound (11) | " | " | 0.49 | 87 | 0.50 | 0.52 | 0.54 | 0.60 | 106 |
| 14 | Exemplary compound (14) | " | " | 0.47 | 88 | 0.47 | 0.49 | 0.52 | 0.58 | 107 |

Control (1)

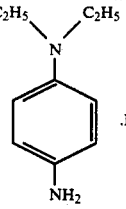

Control (2)

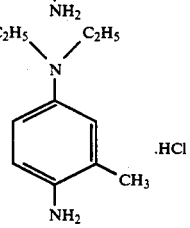

(Note)
Color restoration percentage = Maximum red density in each processing/Maximum red density in CNK-4 standard processing × 100.

As apparently seen from Table 1, when aeration was conducted continuously, no significant increase of stain was observed up to the aeration time of about 10 hours time of 0 and 60 hours, respectively. As the result, although there is difference between the bleach-fixing solutions on aeration time 0, but no difference was recognized in processing after 60 hours' aeration between the present invention and Control.

Further, aeration was also conducted by feeding air in an amount of 4 liter per liter of bleach-fixing solution, which is double amount of Example-1, and the results were the same as described above.

The above-mentioned Sakura Color nega Process CNK-4 which was employed for processing the Control Samples was performed as follows:

The sample was processed according to the following steps:

| Processing step (38° C.) | Processing time |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |

The developing solution employed had the following compositions:

[Color developing solution A]

| | |
|---|---|
| 4-Amino-3-methyl-N—ethyl-N—(β-hydroxyethyl)-aniline sulfate | 4.8 g |
| Potassium hydroquinonemonosulfonate | 40 mg |
| Hydroxyamine ½ sulfate | 2.0 g |
| Anhydrous sodium carbonate | 29.0 g |
| Anhydrous potassium hydrogen carbonate | 3.5 g |
| Potassium sulfite (50% solution) | 9.0 ml |
| Potassium bromide | 1.16 g |
| Sodium chloride | 0.14 g |
| Nitrilotriacetic acid trisodium salt | 1.5 g |
| Potassium hydroxide | 1.5 g |

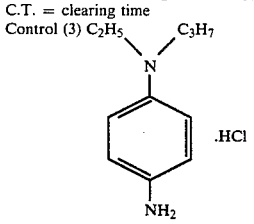

(the total quantity made up to one liter with addition of water)

The bleaching solution employed had the following compositions:

| | |
|---|---|
| Ethylenediaminetetraacetic acid iron ammonium salt | 100.0 g |
| Ethylenediaminetetraacetic acid diammonium salt | 10.0 g |
| Ammonium bromide | 150.0 g |
| glacial acetic acid | 10.0 ml |

(the total quantity made up to one liter with addition of water and adjusted to pH 6.0 with aqueous ammonia).

The fixing solution employed had the following compositions:

| | |
|---|---|
| Ammonium thiosulfate | 175.0 g |
| Anhydrous sodium sulfite | 8.6 g |
| Sodium metasulfite | 2.3 g |

(the total quantity made up to one liter with addition of water and adjusted to pH 6.0 with acetic acid).

The stabilizing solution employed had the following compositions:

| | |
|---|---|
| Formalin (37% aqueous solution) | 1.5 ml |

(the total quantity made up to 1 liter with addition of water)

EXAMPLE-2

Processing was conducted in the same manner as in Example-1, except that a light-sensitive material employing I-(3) in place of the yellow coupler I-(2), I-(11) in place of the magenta coupler I-(7) and I-(16) in place of the cyan coupler I-(17) was used, and the color developing agent and contamination percentage of the color developing solution in the bleach-fixing solution as indicated in Table 2 were employed.

The bleach-fixing processing was conducted by feeding 2 liter/min. of air per liter of bleach-fixing solution through an air spurger over 50 hours.

TABLE 2

| Sample No. | Color developing agent | Bleach-fixing solution | Contamination percentage 0% S* | 0% C.T.** | 0.05% S* | 0.05% C.T.** | 3.5% S* | 3.5% C.T.** | 15% S* | 15% C.T.** | 40% S* | 40% C.T.** |
|---|---|---|---|---|---|---|---|---|---|---|---|---|
| 15 | Control (3) | (1) | 0.94 | >30 min. | 0.97 | >30 min. | 1.01 | >30 min. | 1.06 | >30 min. | 1.12 | >30 min. |
| 16 | Exemplary compound (1) | (1) | 0.89 | >30 min. | 0.91 | >30 min. | 0.94 | >30 min. | 1.00 | >30 min. | 1.03 | >30 min. |
| 17 | Control (3) | (2) | 0.84 | 8 min. | 0.86 | 8 min. | 0.88 | 8 min. 30 sec. | 0.93 | 8 min. 30 sec. | 0.95 | 9 min. |
| 18 | Exemplary compound (1) | (2) | 0.51 | 8 min. | 0.52 | 8 min. | 0.53 | 6 min. 30 sec. | 0.55 | 6 min. | 0.58 | 5 min. 30 sec. |

(Note)
S* = Stain (minimum green density)
C.T. = clearing time

As apparently seen from Table 2, there is obtained a surprising result that in samples other than this invention (Sample Nos. 15 to 17), the desilverization property is markedly deteriorated when contamination percentage is 3.5% or more, while in the present sample (Sample No. 18), the desilverization property is rather improved when contamination percentage is increased.

Color restorations were also evaluated in this Example and each samples exhibited no significant difference in color restoration depending on contamination percentage.

The same evaluations were conducted as in the above evaluation of this Example, except that a quartervalent coupler was employed. The quartervalent coupler has the same structure as the coupler employed in the above evaluation but its releasing part is substituted with hydrogen. As the result, when the quartervalent coupler was used, increase of stain is smaller as compared with that when the bivalent coupler was used.

The results obtained for cyan stain and yellow stain were the same as described above.

EXAMPLE-3

By use of the light-sensitive materials as employed in Example-1, processings were conducted according to the same processing steps as in Example-1. However, the bleach-fixing time was made the time before completion of desilverization at the maximum density portion (clearing time), and the bleach-fixing processing was discontinued at 30 minutes, when desilverization was not completed after processing for 30 minutes.

The color developing solution and the stabilizing solution employed had the same compositions as used in Example - 1, but the color developing agent employed in the color developing solution was the exemplary compound (3).

The bleach-fixing solutions employed had the compositions shown blow.

[Bleach-fixing solution (1)]

| | |
|---|---|
| Ammonium ferric ethylenediamine-tetraacetate dihydrate | 120 g |
| Ethylenediaminetetraacetic acid | 5 g |
| Ammonium thiosulfate (70% solution) | 300 ml |
| Ammonium sulfite (40% solution) | 30 ml |
| Color developing agent | In volume corresponding to contamination percentage shown in Table 3 |
| Silver powder | 5.0 g |
| (adjusted to pH 7.2 with aqueous ammonia, and the total quantity made up to one liter with addition of water). | |

[Bleach-fixing solution (2) (bleach-fixing solution of this invention]

| | |
|---|---|
| Ammonium ferric diethylenetri-aminepentaacetate | 120 g |
| Ethylenediaminetetraacetic acid | 5 g |
| Ammonium thiosulfate (70% solution) | 300 ml |
| Ammonium sulfite (40% solution) | 30 ml |
| XVIII-3 | 1.5 g |
| Color developing agent | In volume corresponding to contamination percentage shown in Table 3 |
| Silver powder | 5.0 g |
| (adjusted to pH 7.2 with aqueous ammonia, and the total quantity made up to one liter with addition of water). | |

-continued

[Bleach-fixing solution (3) (bleach-fixing solution of this invention]

| | |
|---|---|
| Ammonium ferric diethylenetri-aminepentaacetate | 140 g |
| N—hydroxyethylethylenediamine-triacetic acid | 10 g |
| Ammonium thiosulfate (70% solution) | 300 ml |
| Ammonium sulfite (40% solution) | 30 ml |
| XV-4 | 1.5 g |
| Color developing agent | In volume corresponding to contamination percentage shown in Table 3 |
| Silver powder | 5.0 g |
| (adjusted to pH 7.2 with aqueous ammonia, and the total quantity made up to one liter with addition of water). | |

[Bleach-fixing solution (4) (bleach-fixing solution of this invention]

| | |
|---|---|
| Ammonium ferric diethylenetri-aminepentaacetate | 140 g |
| Hydroxyethyliminodiacetic acid | |
| Nickel chloride | 15 g |
| Ammonium thiosulfate (70% solution) | 300 ml |
| Ammonium sulfite (40% solution) | 30 ml |
| XV-5 | 1.0 g |
| Color developing agent | In volume corresponding to contamination percentage shown in Table 3 |
| Silver powder | 5.0 g |
| (adjusted to pH 7.2 with aqueous ammonia, and the total quantity made up to one liter with addition of water). | |

The bleach-fixing solution was stored one day and then transferred into an Erlenmeyer flask, and a part thereof subjected to air oxidation by arranging an air spurger made of a sintered metal with pore sizes of 50 μm and feeding the air at a rate of 2.0 liter/min. per liter of bleach-fixing solution for period shown in Table 1, before it was provided for use in processing.

After processing, the minimum green density subtracting the green density by residual silver (magenta stain) and the maximum red density (cyan dye density) were measured to obtain the results as shown in Table 3.

For comparison, the sample processed by Sakura Color Nega Process CNK-4 which is a standard processing was also similarly measured. However, the desilverization processing time was 6 minutes and 30 seconds for bleaching processing and 6 minutes and 30 seconds for fixing processing.

TABLE 3

| Sample No. | Bleach-fixing solution | Aeration | Contamination percentage | Clearing time | Stain (minimum green density | Color restoration |
|---|---|---|---|---|---|---|
| 1 | (1) | none | 0 | >30 min. | 0.46 | 99% |
| 2 | (1) | none | 15% | " | 0.47 | 79 |
| 3 | (1) | " | 0 | " | 0.85 | 100 |
| 4 | (1) | " | 15% | " | 1.00 | 100 |
| 5 | (2) | none | 0 | 10 min. | 0.46 | 100 |
| 6 | (2) | none | 15% | 15 min. | 0.47 | 80 |
| 7 | (2) | " | 0 | 8 min. | 0.46 | 100 |
| 8 | (2) | " | 15% | 4 min. 30 sec. | 0.48 | 100 |
| 9 | (3) | " | 0 | 9 min. | 0.45 | 100 |
| 10 | (3) | " | 15% | 5 min. | 0.47 | 100 |
| 11 | (4) | " | 0 | 8 min. | 0.46 | 100 |

TABLE 3-continued

| Sample No. | Bleach-fixing solution | Aeration | Contamination percentage | Clearing time | Stain (minimum green density | Color restoration |
|---|---|---|---|---|---|---|
| 12 | (4) | " | 15% | 4 min. 30 sec. | 0.48 | 100 |

As apparently seen from Table 3, according to the processing methods of the present invention (No. 7–12), clearing time, stain and color restoration percentage were all good as compared with the processing methods outside the scope of the invention (No. 1–6).

We claim:

1. A method for processing a light-sensitive silver halide color photographic material comprising developing a light-sensitive silver halide color photographic material after imagewise exposure with a color developing solution containing a p-phenylenediamine type color developing agent containing at least one water-soluble group on its amino group and then subjecting the developed material to direct processing with a bleach-fixing solution maintained in a state of being air oxidized, said bleach-fixing solution containing a diethylenetriaminepentaacetic acid iron (III) complex as the bleaching agent for said bleach-fixing processing.

2. The method according to claim 1, wherein said bleach-fixing processing is conducted with a proportion of the color developing solution brought into said bleach-fixing processing solution, of 2% by volume or more based on said solution.

3. The method according to claim 1, wherein the color developing solution contains a color developing agent having, as the water-soluble group, a group of the formula:

$-(CH_2)_n-CH_2OH$, $-(CH_2)_m-NHSO_2-(CH_2)_n-CH_3$, or $-(CH_2)_mO(CH_2)_n-CH_3$ (m and n are integers of 0 or more).

4. The method according to claim 3, wherein m and n are integers of 0 to 5.

5. The method according to claim 3, wherein said developing agent is selected from the group consisting of

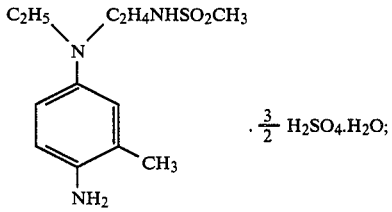

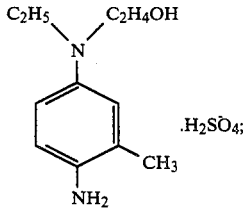

-continued

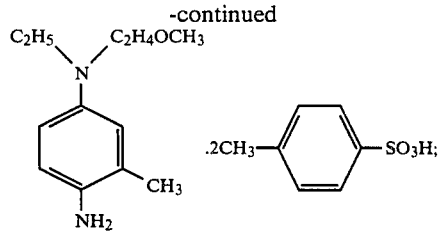

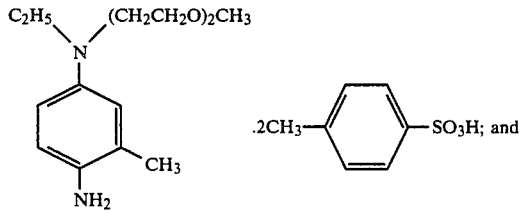

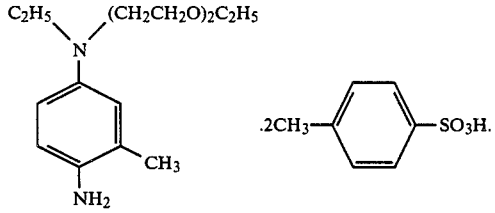

6. The method according to claim 1, wherein said bleach-fixing solution has a pH of 0.2 to 9.5.

7. The method according to claim 1, wherein the diethylenetriaminepentaacetic acid iron (III) complex is sodium salt, potassium salt or ammonium salt of diethylenetriaminepentaacetic acid iron (III).

8. The method according to claim 1, wherein said bleach-fixing solution contains an organic acid.

9. The method according to claim 8, wherein said organic acid is selected from the group consisting of ethylenediaminetetraacetic acid, trans-1,2-cyclohexanediaminetetraacetic acid, 1,3-diaminopropane-2-oltetraacetic acid, ethylenediamine-di-o-hydroxyphenylacetic acid, glycoletherdiaminetetraacetic acid, 1,2-diaminopropanetetraacetic acid, N-hydroxyethylethylenediaminetriacetic acid and triethylenetetraminehexaacetic acid.

10. The method according to claim 8, wherein said organic acid is present in combination with metal ions.

11. The method according to claim 1, wherein said bleach-fixing solution contains a bleaching accelerator.

12. The method according to claim 1, wherein said bleach-fixing processing is conducted with a proportion of the color developing solution brought into said bleach-fixing processing solution, of 2% by volume or more based on said solution; said color developing solution contains a color developing agent having, as the water-soluble group, a group of the formula:

$-(CH_2)_n-CH_2OH$, $-(CH_2)_m-NHSO_2-(CH_2)_n-CH_3$, or $-(CH_2)_mO(CH_2)_n-CH_3$ (m and n are integers of 0 or more);

said diethylenetriaminepentaacetic acid iron (III) complex is sodium salt, potassium salt or ammonium salt of diethylenetriaminepentaacetic acid iron (III); and said bleach-fixing solution contains an organic acid.

13. The method according to claim 12, wherein m and n are integers of 0 to 5; said organic acid is selected from the group consisting of ethylenediaminetetraacetic acid, trans-1,2-cyclohexanediaminetetraacetic acid, 1,3-diaminopropane-2-ol-tetraacetic acid, ethylenediamine-di-o-hydroxyphenylacetic acid, glycoletherdiaminetetraacetic acid, 1,2-diaminopropanetetraacetic acid, N-hydroxyethylethylenediaminetriacetic acid and triethylenetetraminehexaacetic acid; and said bleach-fixing solution contains a bleaching accelerator.

14. The method according to claim 13, wherein said developing agent is selected from the group consisting of

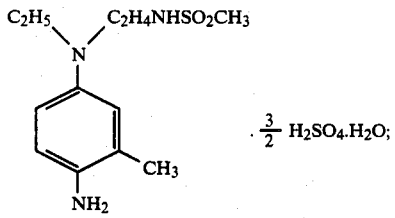

-continued

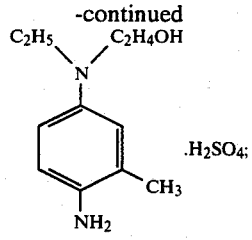

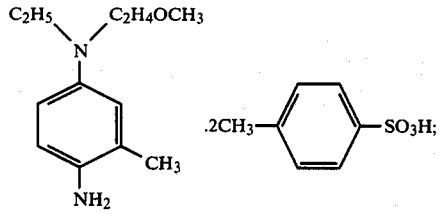

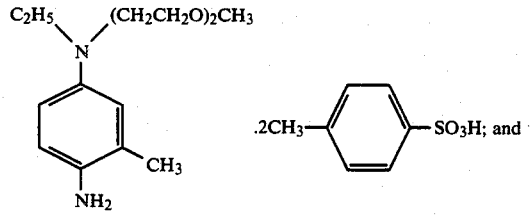

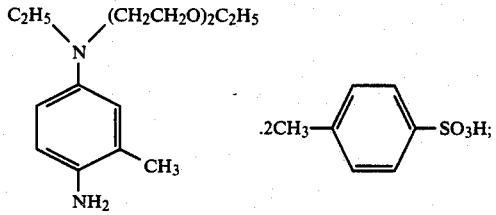

and said organic acid is present in combination with metal ions.

* * * * *

UNITED STATES PATENT AND TRADEMARK OFFICE

CERTIFICATE OF CORRECTION

PATENT NO. : 4,601,975

DATED : July 22, 1986

INVENTOR(S) : Shigeharu KOBOSHI et al

It is certified that error appears in the above-identified patent and that said Letters Patent is hereby corrected as shown below:

On the title page of patent, delete the last two named inventors, "Masahiko Kon" and "Satoru Kuse" from the left-column thereof.

Signed and Sealed this

Ninth Day of December, 1986

*Attest:*

DONALD J. QUIGG

*Attesting Officer*

*Commissioner of Patents and Trademarks*